US011610533B2

(12) United States Patent
Chang et al.

(10) Patent No.: US 11,610,533 B2
(45) Date of Patent: Mar. 21, 2023

(54) DRIVING CIRCUIT

(71) Applicant: AU Optronics Corporation, Hsin-Chu (TW)

(72) Inventors: Che-Chia Chang, Hsin-Chu (TW); Yi-Jung Chen, Hsin-Chu (TW); Shang-Jie Wu, Hsin-Chu (TW); Yu-Chieh Kuo, Hsin-Chu (TW); Hsien-Chun Wang, Hsin-Chu (TW); Ming-Hung Chuang, Hsin-Chu (TW); Mei-Yi Li, Hsin-Chu (TW); He-Yi Cheng, Hsin-Chu (TW); Yi-Fan Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/469,216

(22) Filed: Sep. 8, 2021

(65) Prior Publication Data

US 2022/0114947 A1 Apr. 14, 2022

Related U.S. Application Data

(60) Provisional application No. 63/090,333, filed on Oct. 12, 2020.

(30) Foreign Application Priority Data

Jan. 22, 2021 (TW) ..... 110102501

(51) Int. Cl.
*G09G 3/30* (2006.01)

(52) U.S. Cl.
CPC ..... *G09G 3/30* (2013.01); *G09G 2310/061* (2013.01)

(58) Field of Classification Search
CPC ..... G09G 3/30; G09G 2310/061
See application file for complete search history.

(56) References Cited

U.S. PATENT DOCUMENTS

2014/0111562 A1* 4/2014 Wu ..... G09G 3/3233 315/172
2015/0084843 A1 3/2015 Li et al.
2017/0124941 A1 5/2017 Na et al.

FOREIGN PATENT DOCUMENTS

CN 103400548 A 11/2013
KR 20170049778 A 5/2017
TW I559279 B 11/2016
(Continued)

*Primary Examiner* — Kenneth B Lee, Jr.
(74) *Attorney, Agent, or Firm* — WPAT, PC

(57) ABSTRACT

A driving circuit includes a light-emitting element, a first transistor, a second transistor, a third transistor, a fourth transistor, a first capacitor and a regulator circuit. The first transistor, the second transistor and the light-emitting element are coupled in series between a first system voltage terminal and a second system voltage terminal. A first terminal of the first transistor is coupled to the first system voltage terminal. The third transistor is electrically coupled between a gate terminal and a second terminal of the first transistor. The fourth transistor is electrically coupled between the gate terminal of the first transistor and the second system voltage terminal. A first terminal of the first capacitor is electrically coupled to the gate terminal of the first transistor. A regulator circuit is electrically coupled to a second terminal of the first capacitor.

10 Claims, 7 Drawing Sheets

(56) References Cited

FOREIGN PATENT DOCUMENTS

| | | | |
|---|---|---|---|
| TW | 202044225 | A | 12/2020 |
| TW | 202113783 | A | 4/2021 |

* cited by examiner

DRIVING CIRCUIT

CROSS-REFERENCE TO RELATED APPLICATION

This application claims priority to U.S. Provisional Application Ser. No. 63/090,333 filed Oct. 12, 2020, and Taiwan Application Serial Number 110102501, filed Jan. 22, 2021, the disclosures of which are incorporated herein by reference in their entireties.

BACKGROUND

Field of Invention

The present invention relates to a driving circuit. More particularly, the present invention relates to a driving circuit with voltage compensation.

Description of Related Art

In techniques of displays, some driving circuits may utilize inner compensation operation to compensate a threshold voltage of the driving circuit. However, with higher resolution, the pixel number along a vertical direction of the display may increase, causing the horizontal scanning time being shorter. And, the generally inner compensation operation may cause the issue of insufficient charging rate for the driving circuit.

SUMMARY

One embodiment of the present disclosure is to provide a driving circuit. The driving circuit includes a light emitting element, a first transistor, a second transistor, a third transistor, a fourth transistor, a first capacitor and a regulator circuit. The first transistor, the second transistor and the light emitting element are electrically coupled in series between a first system voltage terminal and a second system voltage terminal. A first terminal of the third transistor is electrically coupled to a second terminal of the first transistor. A second terminal of the third transistor is electrically coupled to a gate terminal of the first transistor. A gate terminal of the third transistor is configured to receive a first control signal. A first terminal of the fourth transistor is electrically coupled to the gate terminal of the first transistor. A second terminal of the fourth transistor is electrically coupled to the second system voltage terminal. A gate terminal of the fourth transistor is configured to receive a second control signal. A first terminal of the first capacitor is electrically coupled to the gate terminal of the first transistor. The regulator circuit is electrically coupled to a second terminal of the first capacitor.

Summary, the driving circuit of the present disclosure compensates the threshold voltage of the first transistor according to the first control signal.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
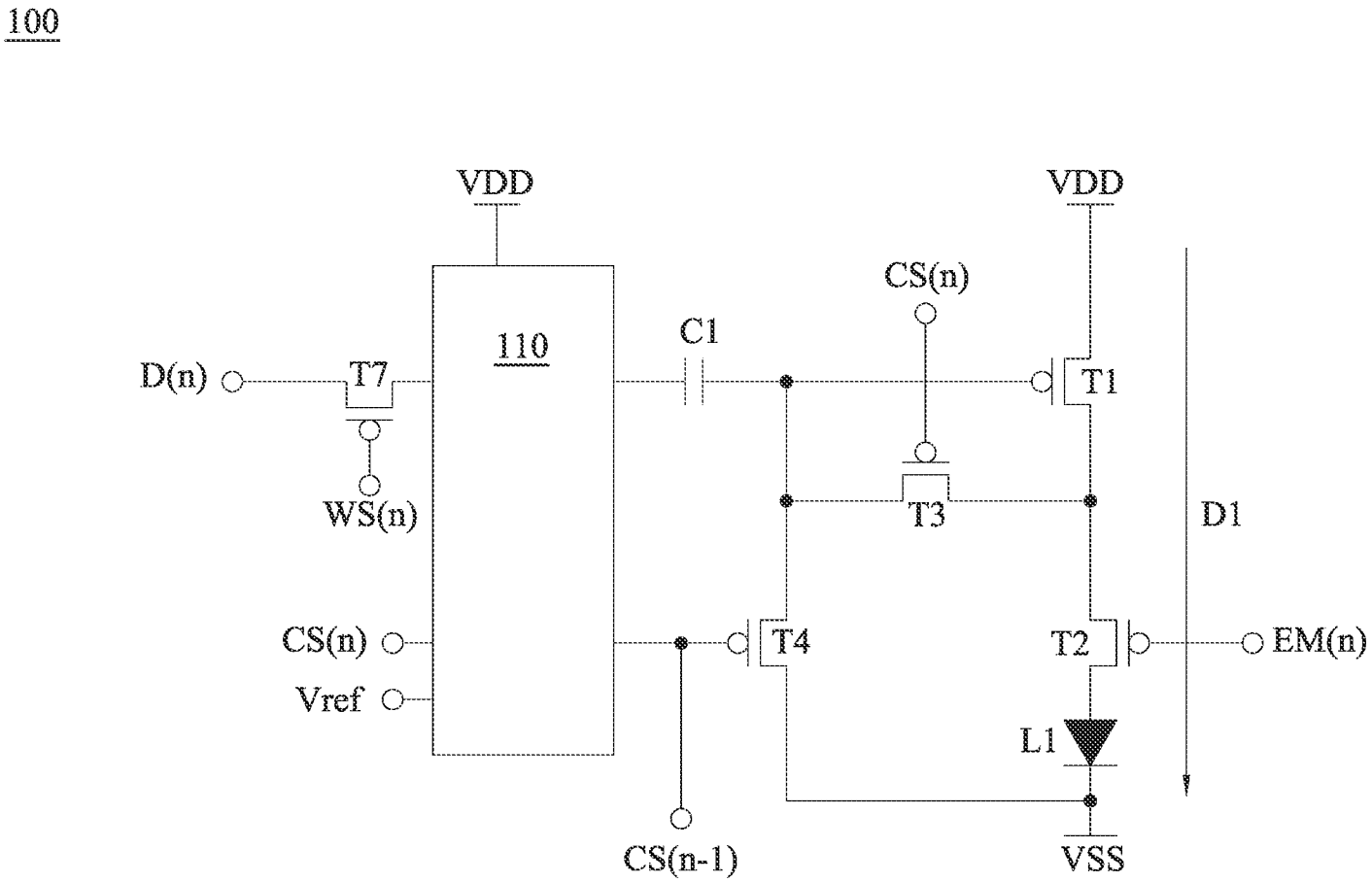
FIG. 1 is a functional block diagram of a driving circuit in accordance with some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

In techniques of nowadays display panels, compare to splice multiple of display panels to form a display device, a display device consists of only one single panel can decrease the dark fringe. However, under the same resolution, the larger display needs more pixels lines. In this case, if each frames of the display is still set at the constant value, the scanning time or the period to write in data (e.g. 3.8 μs) for the single panel (or the panel with large size) is much smaller than the scanning time or the period to write in data (e.g. 7.7 μs) for each of the spliced panels (or the panel with small size). As a result, if the generally operation manner of writing in data and performing compensation at the same time is utilized to the single panel may cause insufficient of charge rate or the data voltage cannot be written normally.

Reference is made to FIG. 1. FIG. 1 is a functional block diagram of a driving circuit 100 in accordance with some embodiments of the disclosure. As shown in FIG. 1, the driving circuit 100 includes a light emitting element L1, a first transistor T1, a second transistor T2, a third transistor T3, a fourth transistor T4, a first capacitor C1 and a regulator circuit 110.

The first transistor T1, the second transistor T2 and the light emitting element L1 are electrically in series between a first system voltage terminal VDD and a second system voltage terminal VSS.

Each of the transistors in the embodiments of in the present disclosure has a first terminal, a second terminal and a gate terminal. If a first terminal of a transistor is drain terminal (or source terminal), a second terminal of the transistor is source terminal (or source terminal). In additional, Each of the capacitors in the embodiments of in the present disclosure has a first terminal and a second terminal. The transistors of the present disclosure are implemented by P-type MOSFET. However, it should not intend to limit the disclosure. In another embodiment, the person skilled in the art can replace the transistors in the embodiments of in the present disclosure by N-type MOSFET, C-type MOSFET or other similar switch elements, and accordingly adjust the system voltages, control signals and the data signals, in order to achieve the functions of the present disclosure.

Specifically, a first terminal of the first transistor T1 is electrically coupled to a first system voltage terminal VDD. A second terminal of the first transistor T1 is electrically coupled to a first terminal of the second transistor T2. A gate terminal of the first transistor T1 is electrically coupled to a first terminal of the first capacitor C1. The first terminal of the second transistor T2 is electrically coupled to the second terminal of the first transistor T1. A second terminal of the second transistor T2 is electrically coupled to a first terminal of the light emitting element L1. A gate terminal of the second transistor T2 is configured to receive a fourth control signal EM(n). A first terminal of the light emitting element L1 is electrically coupled to the second terminal of the second transistor T2. A second terminal of the light emitting element L1 is electrically coupled to a second system voltage terminal VSS.

A first terminal of the third transistor T3 is electrically coupled to the second terminal of the first transistor T1. A second terminal of the third transistor T3 is electrically coupled to the gate terminal of the first transistor T1. A gate terminal of the third transistor T3 is configured to receive a first control signal CS(n). A first terminal of the fourth transistor T4 is electrically coupled to the second terminal of the third transistor T3 and the gate terminal of the first transistor T1. A second terminal of the fourth transistor T4 is electrically coupled to the second system voltage terminal VSS and the second terminal of the light emitting element L1. A gate terminal of the fourth transistor T4 is configured to receive the second control signal CS(n−1). A first terminal of the first capacitor C1 is electrically coupled to the gate terminal of the first transistor T1, the second terminal of the third transistor T3 and the first terminal of the fourth transistor T4. A second terminal of the first capacitor C1 is electrically coupled to the regulator circuit 110.

Figure 2:
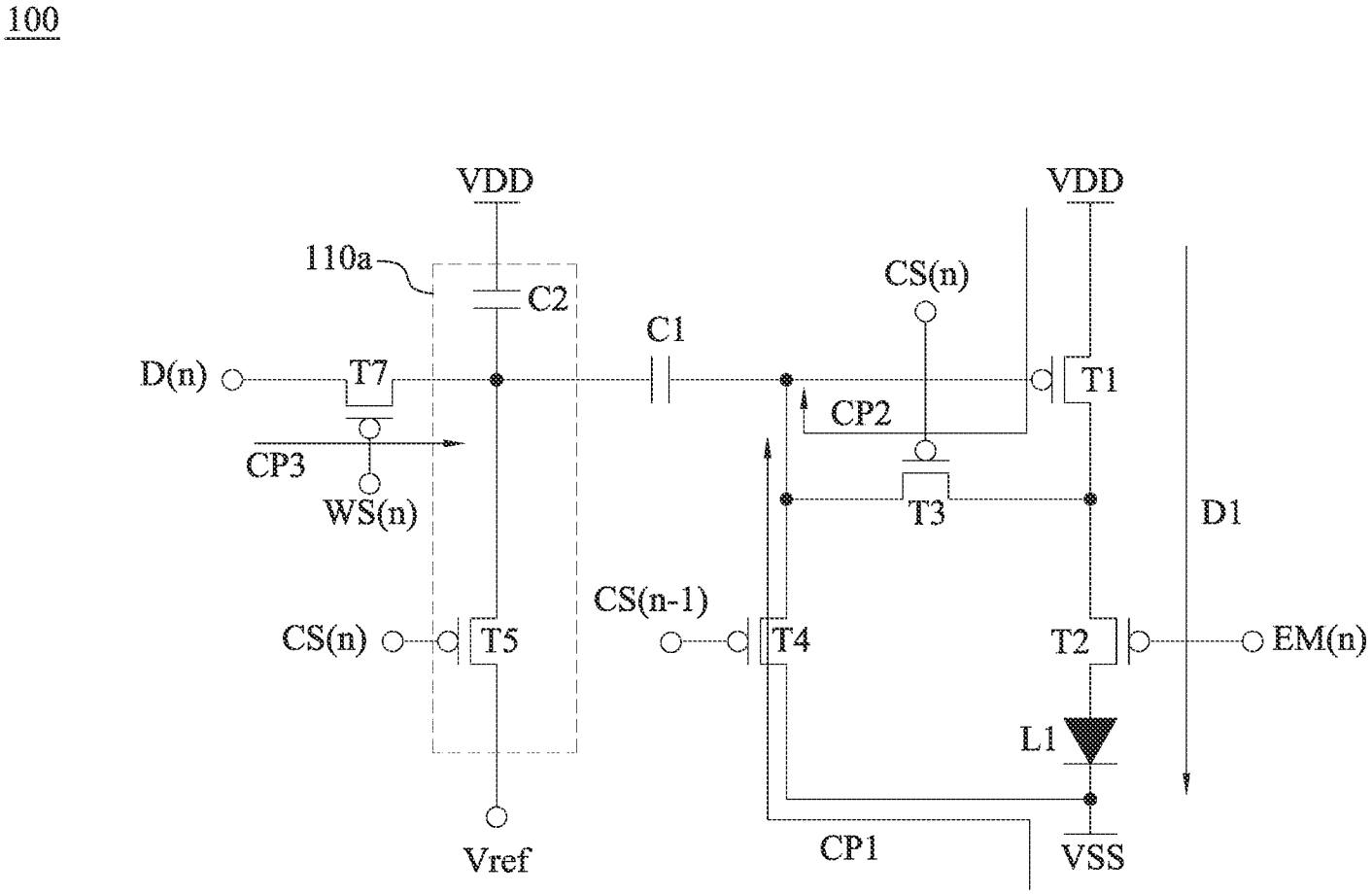
FIG. 2 is a circuit diagram of a driving circuit in accordance with some embodiments of the disclosure.

Reference is made to FIG. 2. FIG. 2 is a circuit diagram of a driving circuit 100 in accordance with some embodiments of the disclosure. The driving circuit 100 as shown in FIG. 2 includes a regulator circuit 110*a*. The regulator circuit 110*a* in FIG. 2 is one of embodiments of the regulator circuit 110 in FIG. 1. As shown in FIG. 2, the regulator circuit 110*a* includes a second capacitor C2 and a fifth transistor T5.

Specifically, a first terminal of the second capacitor C2 is electrically coupled to the first system voltage terminal VDD. A second terminal of the second capacitor C2 is electrically coupled to the second terminal of the first capacitor C1. A first terminal of the fifth transistor T5 is electrically coupled to the second terminal of the second capacitor C2 and the second terminal of the first capacitor C1. A second terminal of the fifth transistor T5*f* is configured to receive the reference voltage Vref. A gate terminal of the fifth transistor T5 is configured to receive the first control signal CS(n).

The driving circuit 100 further includes a seventh transistor T7. A first terminal of the seventh transistor T7 is configured to receive the data signal D(n). A second terminal of the seventh transistor T7 is electrically coupled to the second terminal of the second capacitor C2, the second terminal of the first capacitor C1 and the first terminal of the fifth transistor T5. A gate terminal of the seventh transistor T7 is configured to receive the third control signal WS(n).

Figure 3:
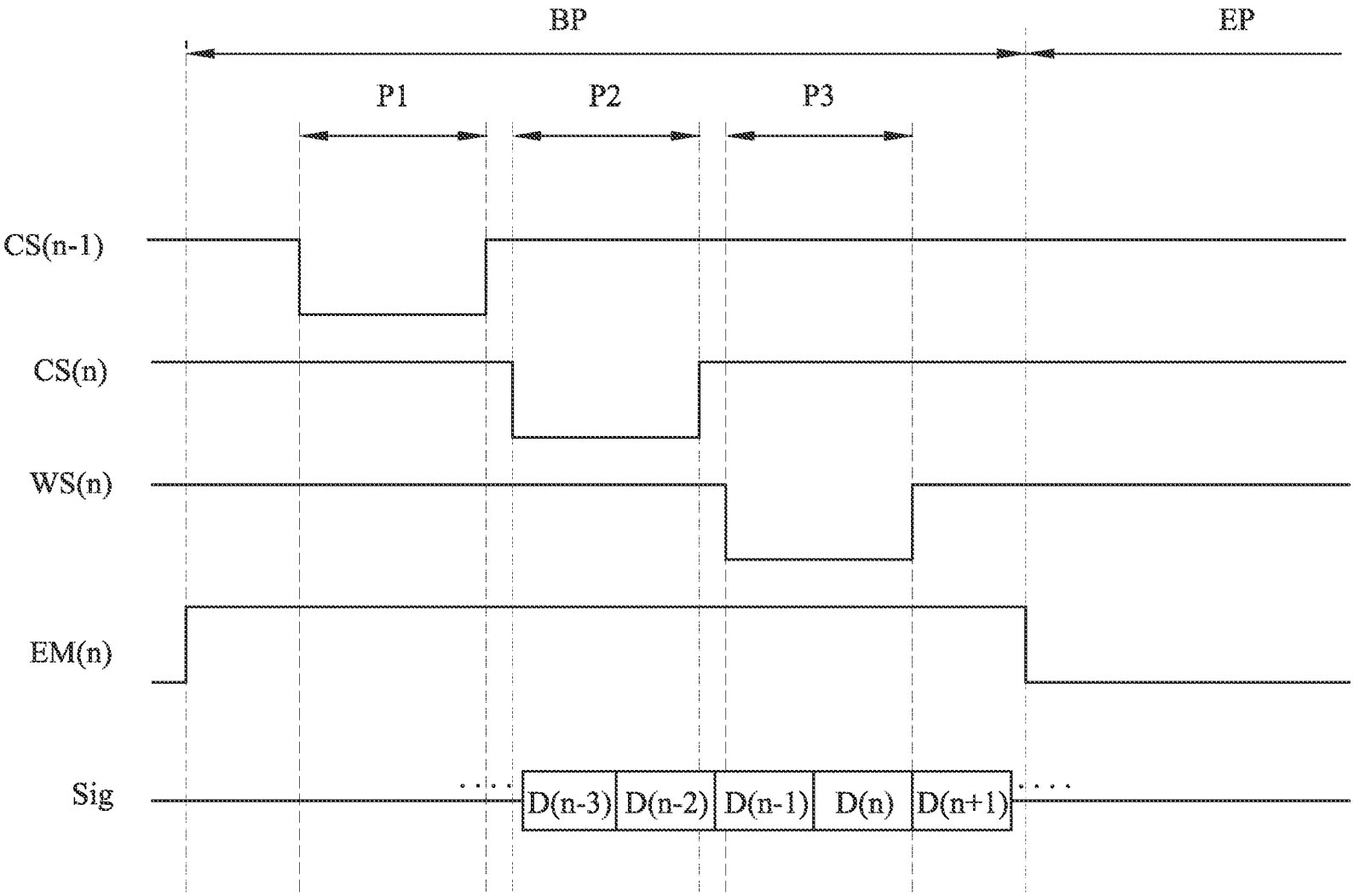
FIG. 3 is a timing diagram of control signals of the driving circuit shown in FIG. 2 in accordance with some embodiment.

FIG. 3 is a timing diagram of control signals of the driving circuit 100 shown in FIG. 2 in accordance with some embodiment. As shown in FIG. 3, one display period of the control timing can be divided into two main periods; the two main periods are a setting period BP and an emission period EP. The setting period BP can be considered as non-emission period. The emission period EP can be considered as emission time that the driving circuit 100 can occupy in one display period. In additional, the setting period BP can be divided into three periods. The three periods are a reset period P1, a compensation period P2 and a writing period. To be noted that, the time lengths of the time periods in FIG. 2 are for examples, it should not intend to limit the present disclosure.

Specifically, during the reset period P1, the first control signal CS(n) has a first logic level (such as, a low logic level). During the compensation period P2 and the writing period P3, the first control signal CS(n) has a second logic level (such as, a high logic level). During the compensation period P2, the second control signal CS(n−1) has the low logic level. During the reset period P1 and the writing period P3 the second control signal CS(n−1) has the high logic level. During the writing period P3, the third control signal WS(n) has the low logic level. During the reset period P1 and the compensation period P2, the third control signal WS(n) has the high logic level. During the emission period EP, the first control signal CS(n), the second control signal CS(n−1) and the third control signal WS(n) has the high logic level. During the setting period BP, the fourth control signal EM(n) has the high logic level. During the emission period EP, the fourth control signal EM(n) has the low logic level.

In the reset period P1, since the second control signal CS(n−1) has the low logic level, the fourth transistor T4 conducts. On the other hand, since the first control signal CS(n), the third control signal WS(n) and the fourth control signal EM(n) have the low logic level, the second transistor T2, the third transistor T3, the fifth transistor T5 and the seventh transistor T7 turn off.

Specifically, during the reset period P1, since fourth transistor T4 conducts, a current path CP1 is formed from the second system voltage terminal VSS through the fourth transistor T4 to the first terminal of the first capacitor C1, such that the voltage of the second system voltage terminal VSS is transmitted through the fourth transistor T4 to the first terminal of the first capacitor C1. And, since the voltage level at the gate terminal of the first transistor T1 (the first terminal of the first capacitor C1) is pulled down to the low logic level by the voltage of the second system voltage terminal VSS, the first transistor T1 conducts.

In the compensation period P2, since the first control signal CS(n) has the low logic level, the third transistor T3 and the fifth transistor T5 conduct. On the other hand, since the second control signal CS(n−1), the third control signal WS(n) and the fourth control signal EM(n) has the high logic level, the first transistor T1, the second transistor T2, the fourth transistor T4 and the seventh transistor T7 turn off.

Specifically, in the initial of the compensation period P2, since the voltage level at the gate terminal of the first transistor T1 (the first terminal of the first capacitor C1) is logical low, the first transistor T1 conducts. And, since the first transistor T1 and the third transistor T3 conduct, a current path CP2 is formed from the first system voltage terminal VDD through the first transistor T1 and the third transistor T3 to the gate terminal of the first transistor T1, such that the voltage of the first system voltage terminal VDD is transmitted through the first transistor T1 and the third transistor T3 to the gate terminal of the first transistor T1, until a cross voltage between the gate terminal and source terminal (the first terminal) of the first transistor T1 is equal to a threshold voltage of the first transistor T1, the first transistor T1 turns off. Therefore, the compensation operation for the threshold voltage of the first transistor T1 can be performed.

In the compensation period P2, since the fifth transistor T5 conducts, the reference voltage Vref is transmitted through the fifth transistor T5 to the second terminal of the first capacitor C1.

In the writing period P3, since the third control signal WS(n) has the low logic level, the seventh transistor T7 conducts. On the other hand, since the first control signal CS(n), the second control signal CS(n−1) and the fourth control signal EM(n) have the high logic level, the first transistor T1, the second transistor T2, the third transistor T3, the fourth transistor T4 and the fifth transistor T5 turn off.

In the writing period P3, since the seventh transistor T7 conducts, a current path CP3 is formed through the seventh transistor T7 to the second terminal of the first capacitor C1, such that the data signal D(n) is transmitted through the seventh transistor T7 to the second terminal of the first capacitor C1, and the data signal D(n) is transmitted to the gate terminal of the first transistor T1 through the capacitance coupling effect, so as to write the data signal D(n) into the driving circuit 100.

To be noted that, since the driving circuit 100 respectively performs the compensation of the threshold of the first transistor T1 and write the data signal D(n) according to the first control signal CS(n) and the third control signal WS(n). Therefore, the compensation period P2 and the writing period P3 of the driving circuit 100 can operate independently. And, the time lengths that the first control signal CS(n) and the third control signal WS(n) at the low logic level can be adjusted. In some embodiments, the time length of each of the first control signal CS(n), the second control signal CS(n−1), the third control signal WS(n) and the fourth control signal EM(n) can be one time unit (such as, 3.8 μs). In other embodiments, the time length of each of the first control signal CS(n), the second control signal CS(n−1), the third control signal WS(n) and the fourth control signal EM(n) can be two time units (such as, 2*3.8 μs).

In some other embodiments, some driving circuits, which perform the data written operation and the inner compensation operation at one time and compensate the threshold voltage according to the data signals. In this case, if the operation timing of these driving circuits have pre-charge time, the data signal with the higher gray level provided for the previous driving circuit may be incorrect written into the present driving circuit, and the present driving circuit may use the incorrect data signal to compensate the threshold voltage, which may cause the driving transistor turns off. Therefore, the correct data signal with the lower gray level provided for the present one driving circuit may not be correctly written into the corresponding circuit, since the incorrect data signal with the higher gray level has been received by the present one driving circuit. In additional, in other embodiments, some driving circuits, which perform data written operation and inner compensation operation at one time and compensate the threshold voltage according to the current control signal and the previous control signal with partially overlapping enable periods. In this case, the insufficient charge rate of the driving circuit may cause the mura on the adjacent lines of the display.

Therefore, under the architecture of the driving circuit 100 in the present disclosure, the data signal D(n) is written into the driving circuit 100 through the capacitance coupling effect during the writing period P3, instead of performing the inner compensation operation for the threshold voltage of the transistor, and therefore the present driving circuit can avoid receiving the incorrect data (e.g. the data signal provided for the previous driving circuit). And, in one display frame, the time periods that the second control signal CS(n−1) (previous control signal) and the first control signal CS(n) (present control signal) at the low logic level are non-overlapping to each other. In other words, the reset period P1 does not overlap with the compensation period P2. And, the time period that the third control signal WS(n) at the low logic level does not overlap with the time periods that the second control signal CS(n−1) (previous control signal) and the first control signal CS(n) (present control signal) at the low logic level. In other words, the writing period P3 does not overlap with the compensation period P2. Therefore, the writing period P3 can be set to extend the pre-charge time length according to the product functions, the data signal D(n) can still be correctly received by the driving circuit 100, and to reverse enough time to write the data signal D(n) into the driving circuit 100, so as to increase the display image uniformity and the charge rate of the display.

Specifically, as shown in FIG. 3, the data line Sig respectively provides data signal D(n−3)~D(n+1) to the driving circuits in different lines. The driving circuit 100 is configured to receive the data signal D(n). The time point that the third control signal WS(n) switches from the high logic level to the low logic level can be moved up to early than the data signal D(n), in order to perform the pre-charge by receiving the data signal D(n−1), And, the time point that the third control signal WS(n) switches from the high logic level to the low logic level need to be set in the period for receiving the data signal D(n), so as to write the data signal D(n) into the driving circuit 100 through the capacitance coupling effect. To be noted that, the data signal D(n−3)~D(n+1) of the data line Sig as shown in FIG. 3 are only for examples, it should not intend to limit the present disclosure.

In the emission period EP, since the first control signal CS(n), the second control signal CS(n−1) and the third control signal WS(n) has the high logic level, the first transistor T1, the third transistor T3, the fourth transistor T4, the fifth transistor T5 and the seventh transistor T7 turn off. On the other hand, since the fourth control signal EM(n) has the low logic level, the second transistor T2 conducts.

In the emission period EP, since the second transistor T2 conducts, the driving current D1 flows from the first system voltage terminal VDD through the first transistor T1, the second transistor T2, the light emitting element L1 to the second system voltage terminal VSS. And, the amplitude value of the driving current D1 is associated with voltage level at the gate terminal of the first transistor T1. In order to control the gray level of the light emitting element L1 in the driving circuit 100 according to the data signal D(n) provided in the writing period P3.

To be noted that, as shown in FIG. 3, the fourth control signal EM(n) is logical low during the emission period EP (emission time), so as to continuous emit during the emission period EP in one frame. In some embodiment, during the emission period EP (emission time), the fourth control signal EM(n) can be alternately switched between the high logic level and the low logic level, to perform multi-impulse in emission periods of one frame, and to support G-SYNC techniques, so as to achieve power saving function.

In some embodiments, during the setting period BP, the time length that the fourth control signal EM(n) at the high logic level can be eight time units (such as 8*3.8 μs).

Figure 4:
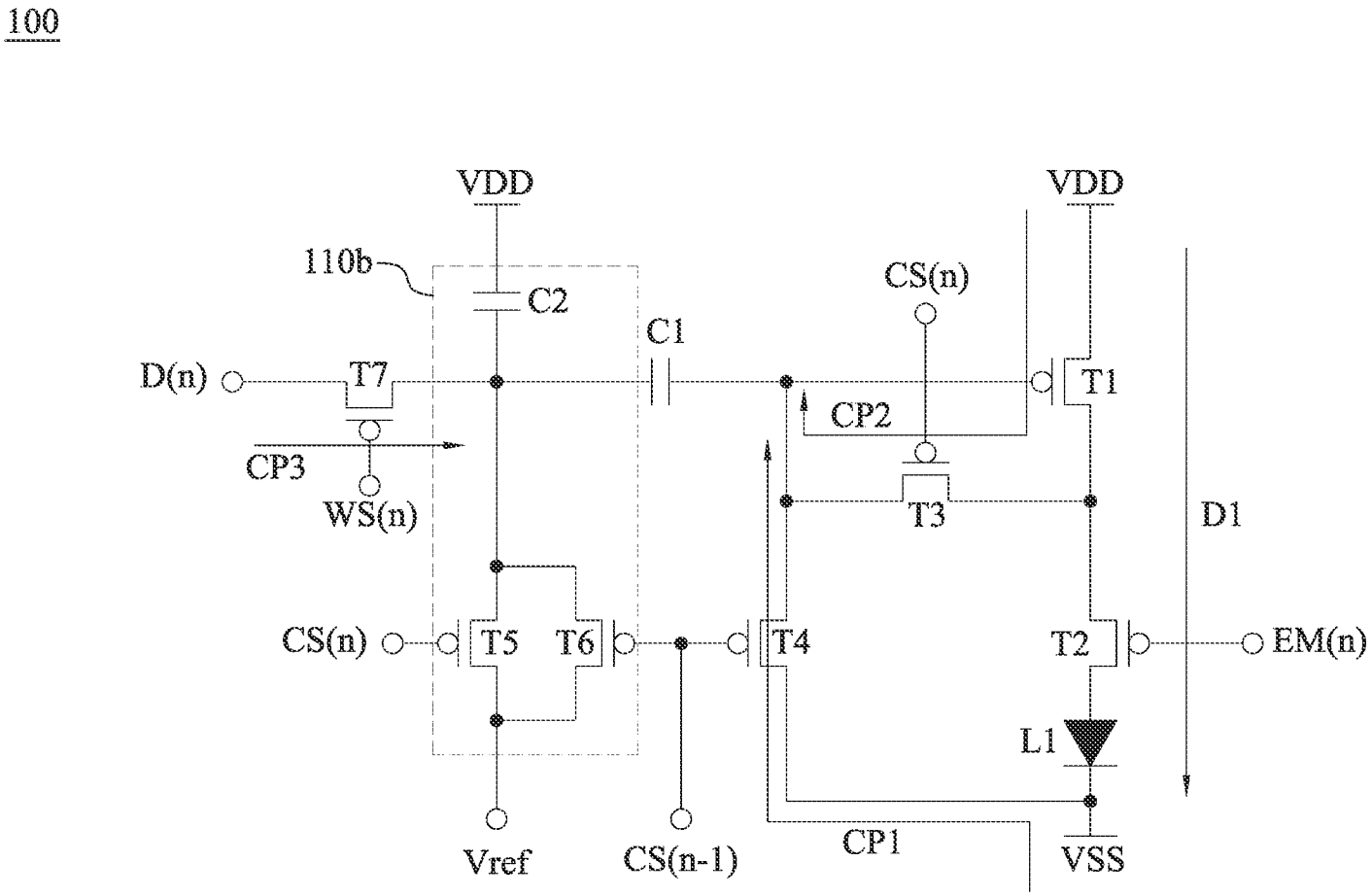
FIG. 4 is a circuit diagram of a driving circuit in accordance with some embodiments of the disclosure.

Another embodiment of the present disclosure can also achieve the effect of the embodiment in FIG. 2. Reference is made to FIG. 4. FIG. 4 is a circuit diagram of a driving circuit 100 in accordance with some embodiments of the disclosure. As shown in FIG. 4, the driving circuit 100 includes a regulator circuit 110*b*. The regulator circuit 110*b* in FIG. 4 is another embodiment of the regulator circuit 110 in FIG. 1. Compare to the driving circuit 100*a* in FIG. 2 including the second capacitor C2 and the fifth transistor T5, the driving circuit 100*b* in FIG. 4 including the second capacitor C2, the fifth transistor T5 and the sixth transistor T6.

In structure, a first terminal of the sixth transistor T6 is electrically coupled to the first terminal of the fifth transistor T5. A second terminal of the sixth transistor T6 is electrically coupled to the second terminal of the fifth transistor T5. A gate terminal of the sixth transistor T6 is configured to receive the second control signal CS(n−1). And, the gate terminal of the sixth transistor T6 is electrically coupled to the gate terminal of the fourth transistor T4.

To be noted that, in this embodiment, during the reset period, the sixth transistor T6 conducts according to the second control signal CS(n−1), such that the reference voltage Vref is transmitted through the sixth transistor T6 to the second terminal of the first capacitor C1, so as to regulate the voltage level at the second terminal of the first capacitor C1. The detailed connect relationship and operation manner of the driving circuit 100 are similar with the driving circuit 100 of the embodiment in FIG. 2, and thus the explanations are omitted.

Figure 5:
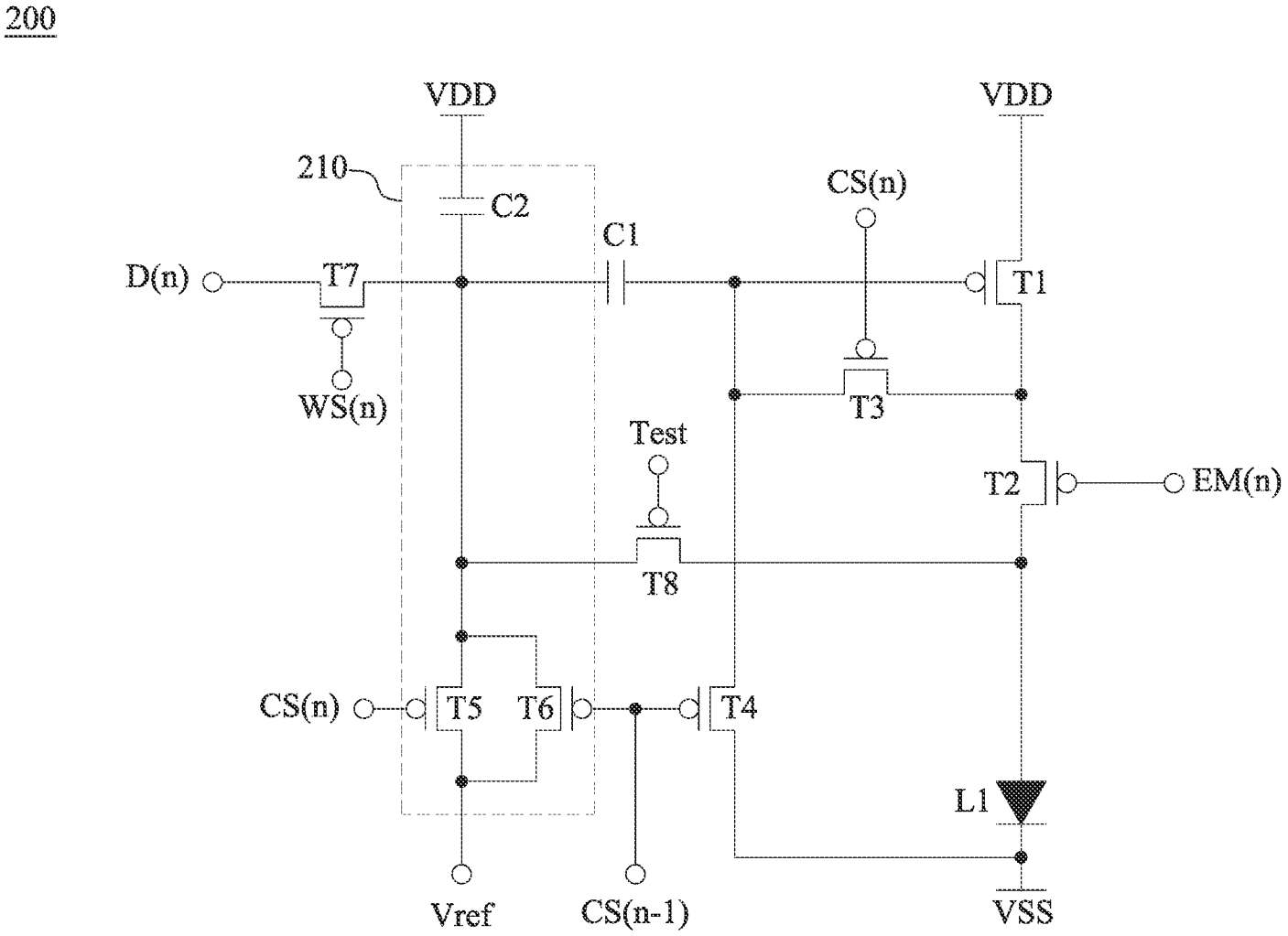
FIG. 5 is a circuit diagram of a driving circuit in accordance with some embodiments of the disclosure.

The other embodiment of the present disclosure can also achieve the effect of the embodiment in FIG. 2. Reference is made to FIG. 5. FIG. 5 is a circuit diagram of a driving circuit 200 in accordance with some embodiments of the disclosure. The driving circuit 200 includes a first transistor T1, a second transistor T2, a third transistor T3, a fourth transistor T4, a seventh transistor T7, an eighth transistor T8, a regulator circuit 210, a first capacitor C1 and a light emitting element L1. The regulator circuit 210 includes a fifth transistor T5, a sixth transistor T6 and a second capacitor C2.

Compare to the driving circuit 100 of the embodiment in FIG. 4, the driving circuit 200 of the embodiment in FIG. 5 further includes an eighth transistor T8. And, control signals of the driving circuit 200 can also be implemented by control signals in timing diagram of the driving circuit 100 as shown in FIG. 3.

In structure, a first terminal of the eighth transistor T8 is electrically coupled to a second terminal of the second capacitor C2, a first terminal of the fifth transistor T5 and a terminal of the sixth transistor T6. A second terminal of the eighth transistor T8 is electrically coupled to a second terminal of the second transistor T2 and a first terminal of the light emitting element L1. A gate terminal of the eighth transistor T8 is configured to receive a test signal Test. As a result, before the light emitting element L1 is mounted, a current path, for detecting the circuit, can be formed from the first system voltage terminal VDD through the first transistor T1, the second transistor T2, the eighth transistor T8, the fifth transistor T5 to the reference voltage Vref, or through the first transistor T1, the seventh transistor T7 to the data signal D(n). The detailed connect relationship and operation manner of the driving circuit 200 are similar with the driving circuit 100 of the embodiment in FIG. 4, and thus the explanations are omitted.

Figure 6:
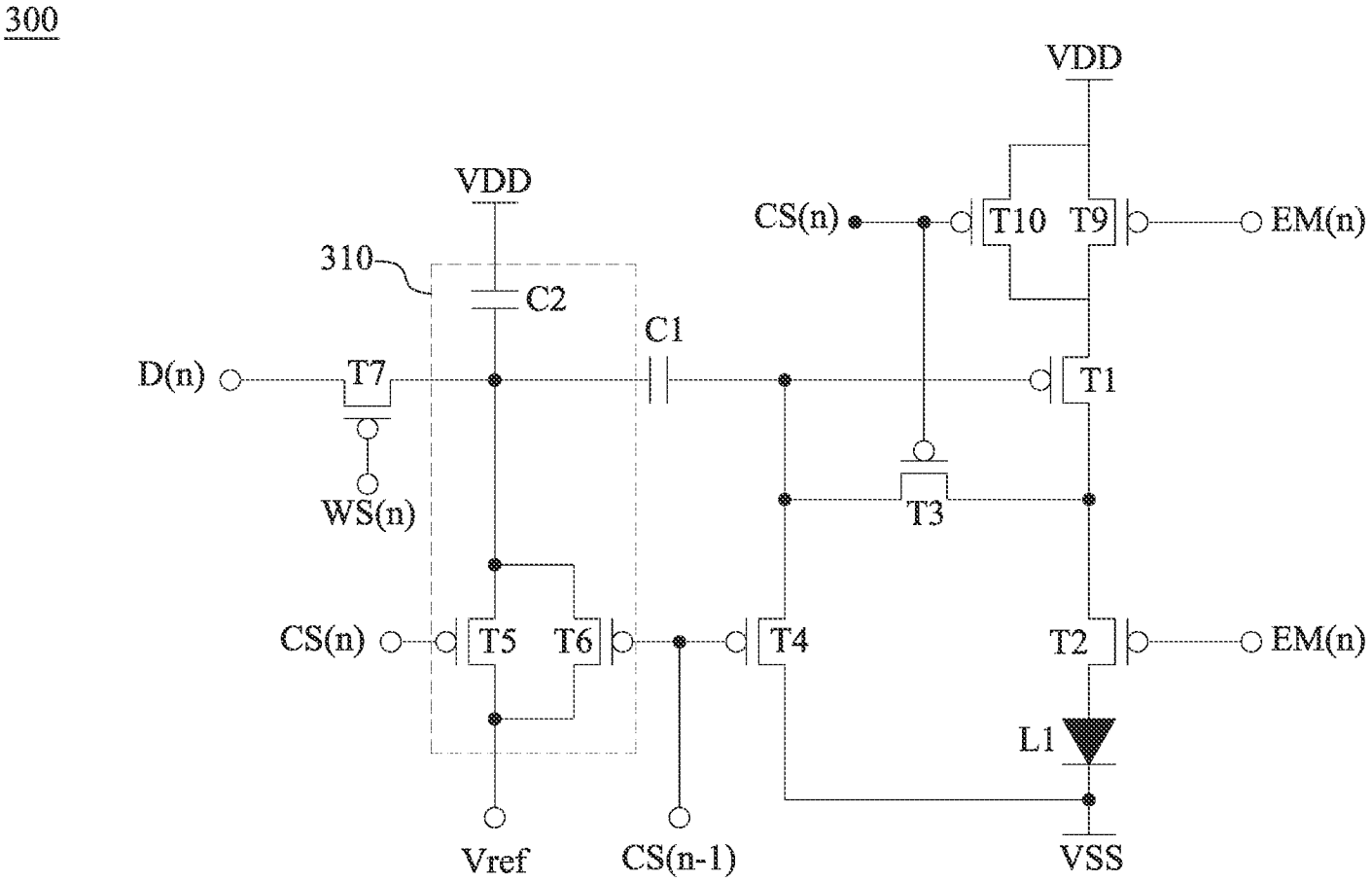
FIG. 6 is a circuit diagram of a driving circuit in accordance with some embodiments of the disclosure.

The other embodiment of the present disclosure can also achieve the effect of the embodiment in FIG. 1. Reference is made to FIG. 6. FIG. 6 is a circuit diagram of a driving circuit 300 in accordance with some embodiments of the disclosure. The driving circuit 300 includes a first transistor T1, a second transistor T2, a third transistor T3, a fourth transistor T4, a seventh transistor T7, an ninth transistor T9, a tenth transistor T10, a regulator circuit 310, a first capacitor C1 and a light emitting element L1. The regulator circuit 310 includes a fifth transistor T5, a sixth transistor T6 and a second capacitor C2.

Compare to the driving circuit 100 of the embodiment as shown in FIG. 4, the driving circuit 300 of the embodiment as shown in FIG. 6 further an ninth transistor T9 and a tenth transistor T10. And, the operation timing of control signals of the driving circuit 300 can also be implemented by the operation timing of control signals of the driving circuit 100 as shown in FIG. 3.

In structure, a first terminal of the ninth transistor T9 is electrically coupled to the first system voltage terminal VDD. A second terminal of the ninth transistor T9 is electrically coupled to a first terminal of the first transistor T1. A gate terminal of the ninth transistor T9 is configured to receive the fourth control signal EM(n). A second terminal of the first transistor T1 is electrically coupled to the first terminal of the second transistor T2. A second terminal of the second transistor T2 is electrically coupled to a first terminal of the light emitting element L1. A second terminal of the light emitting element L1 is electrically coupled to the second system voltage terminal VSS.

A first terminal of the tenth transistor T10 is electrically coupled to the first system voltage terminal VDD and the first terminal of the ninth transistor T9. A second terminal of the tenth transistor T10 is electrically coupled to the first terminal of the first transistor T1 and the second terminal of the ninth transistor T9. A gate terminal of the tenth transistor T10 is configured to receive the first control signal CS(n).

Compare to the driving circuit 100 of the embodiment shown in FIG. 4, the driving circuit 300 of the embodiment shown in FIG. 6 further includes an ninth transistor T9 and a tenth transistor T10, on order to avoid voltage degradation in the driving circuit 300. The detailed connect relationship and operation manner of the driving circuit 300 in FIG. 6 are similar with the driving circuit 100 of the embodiment in FIG. 4, and thus the explanations are omitted.

Figure 7:
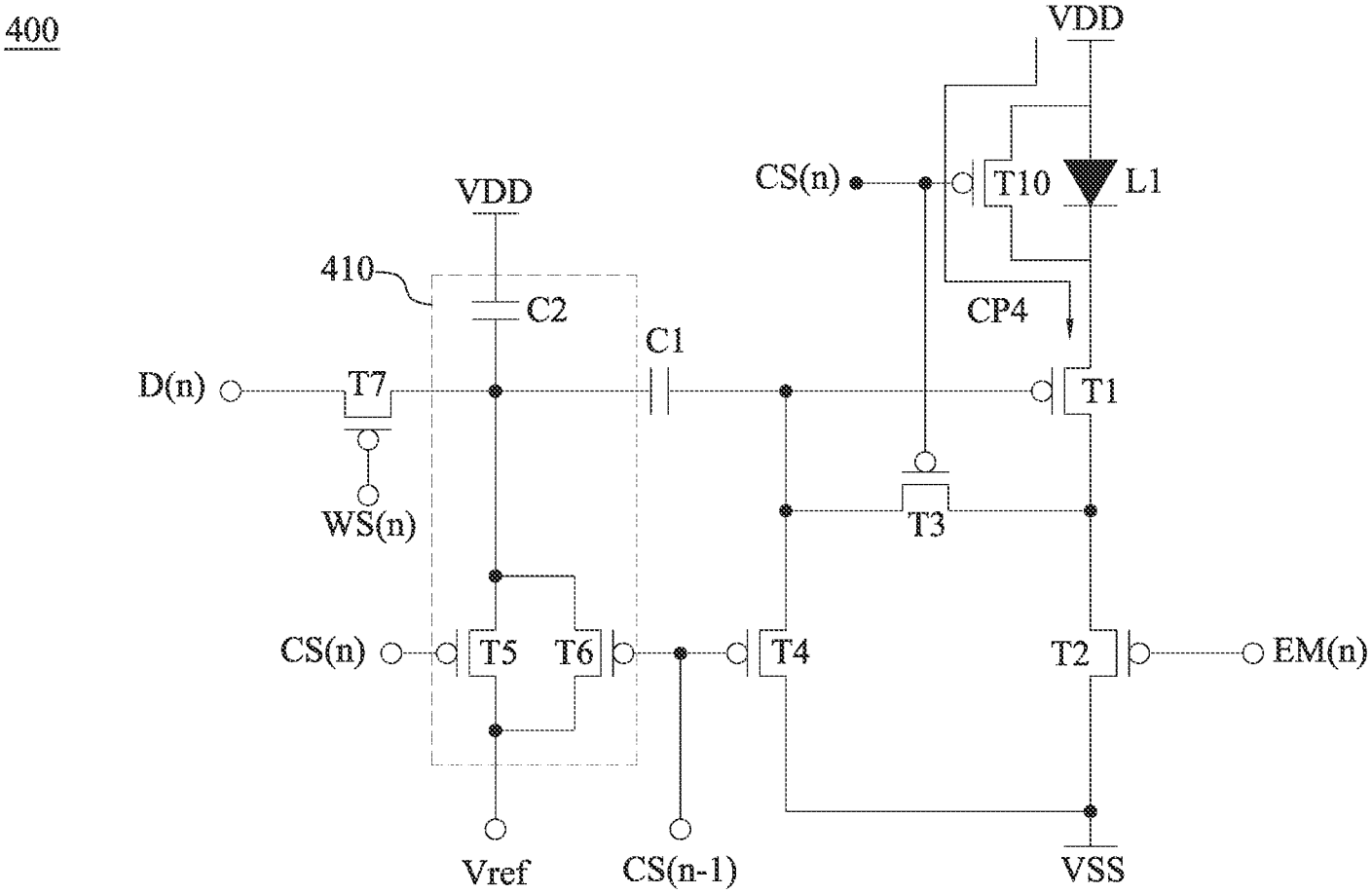
FIG. 7 is a circuit diagram of a driving circuit in accordance with some embodiments of the disclosure.

The other embodiment of the present disclosure can also achieve the effect of the embodiment in FIG. 2. Reference is made to FIG. 7. FIG. 7 is a circuit diagram of a driving circuit 400 in accordance with some embodiments of the disclosure. The driving circuit 400 includes a first transistor T1, a second transistor T2, a third transistor T3, a fourth transistor T4, a seventh transistor T7, a tenth transistor T10, a regulator circuit 410, a first capacitor C1 and a light emitting element L1. The regulator circuit 410 includes a fifth transistor T5, a sixth transistor T6 and a second capacitor C2.

Compare to the driving circuit 300 of the embodiment in FIG. 6, the driving circuit 400 of the embodiment in FIG. 7 can operate without the ninth transistor T9. In additional, operation timing of the driving circuit 300 can be also implemented by the operation timing of the driving circuit 100 as shown in FIG. 3.

In structure, a first terminal of the tenth transistor T10 is electrically coupled to the first system voltage terminal VDD and a first terminal of the light emitting element L1. A second terminal of the tenth transistor T10 is electrically coupled to a first terminal of the first transistor T1 and a second terminal of the light emitting element L1. A gate terminal of the tenth transistor T10 terminal of is configured to receive the first control signal CS(n). A second terminal of the first transistor T1*f* is electrically coupled to a first terminal of the second transistor T2. A second terminal of the second transistor T2 is electrically coupled to the second system voltage terminal VSS. In the compensation period P2, the tenth transistor T10 conducts according to the first control signal CS(n), and a current path CP4 is formed, for detecting the circuit, form the first system voltage terminal VDD through the tenth transistor T10 to the first terminal of the first transistor T1, such that the voltage of the first system voltage terminal VDD can be transmitted through the tenth transistor T10 to the first terminal of the first transistor T1. The detailed connect relationship and operation manner of the driving circuit 400 in FIG. 7 are similar with the driving circuit 100 of the embodiment in FIG. 4, and thus the explanations are omitted.

Summary, the compensation period P2 can non-overlap to the writing period P3 of each of the driving circuits 100, 200, 300 and 400. Therefore, the time length of the writing period P3 in the operation timing can be increased to ensure the driving circuits 100, 200, 300 and 400 have enough time to pre-charge, in order to increase uniformity of the display image.

Although specific embodiments of the disclosure have been disclosed with reference to the above embodiments, these embodiments are not intended to limit the disclosure. Various alterations and modifications may be performed on the disclosure by those of ordinary skills in the art without departing from the principle and spirit of the disclosure. Thus, the protective scope of the disclosure shall be defined by the appended claims.

What is claimed is:

1. A driving circuit, comprising:

a light emitting element;

a first transistor;

a second transistor, wherein the first transistor, the second transistor and the light emitting element are electrically coupled in series between a first system voltage terminal and a second system voltage terminal;

a third transistor, with a first terminal electrically coupled to a second terminal of the first transistor, with a second terminal electrically coupled to a gate terminal of the first transistor, with a gate terminal configured to receive a first control signal;

a fourth transistor, with a first terminal electrically coupled to the gate terminal of the first transistor, with a second terminal electrically coupled to the second system voltage terminal, with a gate terminal configured to receive a second control signal;

a first capacitor, with a first terminal electrically coupled to the gate terminal of the first transistor;

a regulator circuit, electrically coupled to a second terminal of the first capacitor; and a seventh transistor, with a first terminal configured to receive a data signal, with a second terminal electrically coupled to a second terminal of the first capacitor, with a gate terminal configured to receive a third control signal.

2. The driving circuit of claim 1, wherein the regulator circuit comprising:

a second capacitor, with a first terminal electrically coupled to the first system voltage terminal, with a second terminal electrically coupled to the second terminal of the first capacitor; and a fifth transistor, with a first terminal electrically coupled to the second terminal of the second capacitor, with a second terminal configured to receive a reference voltage, with a gate terminal configured to receive the first control signal.

3. The driving circuit of claim 2, wherein the driving circuit sequentially operates in a reset period and a compensation period, wherein:

during the reset period, the second control signal has a first logic level to conduct the fourth transistor, such that voltage of the second system voltage terminal is transmitted through the fourth transistor to the first terminal of the first capacitor to conduct the first transistor, and the first control signal has a second logic level to turn off the third transistor and the fifth transistor; and during the compensation period, the first control signal has the first logic level to conduct the third transistor and the fifth transistor, such that the reference voltage is transmitted through the fifth transistor to the second terminal of the first capacitor, and the voltage of the first system voltage terminal is transmitted through the first transistor and the third transistor to the gate terminal of the first transistor, and the second control signal has the second logic level to turn off the fourth transistor.

4. The driving circuit of claim 2, wherein the regulator circuit further comprising:

a sixth transistor, with a first terminal electrically coupled to the first terminal of the fifth transistor, with a second terminal electrically coupled to the second terminal of the fifth transistor, with a gate terminal configured to receive the second control signal.

5. The driving circuit of claim 4, wherein the driving circuit sequentially operates in a reset period and a compensation period, wherein:

during the reset period, the second control signal has a first logic level to conduct the fourth transistor and the sixth transistor, such that voltage of the second system voltage terminal is transmitted through the fourth transistor to the first terminal of the first capacitor to conduct the first transistor, the reference voltage is transmitted through the sixth transistor to the second terminal of the first capacitor, and the first control signal has a second logic level to turn off the third transistor and the fifth transistor; and during the compensation period, the first control signal has the first logic level to conduct the third transistor and the fifth transistor, such that the reference voltage is transmitted through the fifth transistor to the second terminal of the first capacitor, voltage of the first system voltage terminal is transmitted through the first transistor and the third transistor to the gate terminal of the first transistor, and the second control signal has the second logic level to turn off the fourth transistor and the sixth transistor.

6. The driving circuit of claim 1, wherein during a writing period, the third control signal has a first logic level to conduct the seventh transistor, such that the data signal is transmitted through the seventh transistor to the second terminal of the first capacitor, and wherein the first control signal and the second control signal has a second logic level to turn the third transistor, the fourth transistor and the fifth transistor.

7. The driving circuit of claim 1, wherein a first terminal of the first transistor is electrically coupled to the first system voltage terminal, wherein the second terminal of the first transistor is electrically coupled to a first terminal of the second transistor, wherein a second terminal of the second transistor is electrically coupled to a first terminal of the light emitting element, wherein a gate terminal of the second transistor is configured to receive a fourth control signal, and wherein a second terminal of the light emitting element is electrically coupled to the second system voltage terminal.

8. The driving circuit of claim 7, further comprising:

an eighth transistor, with a first terminal electrically coupled to a second terminal of the first capacitor, with a second terminal electrically coupled to the second terminal of the second transistor, with a gate terminal configured to receive a test signal.

9. The driving circuit of claim 1, further comprising:

a ninth transistor, with a first terminal electrically coupled to the first system voltage terminal, with a second terminal electrically coupled to a first terminal of the first transistor, with a gate terminal configured to receive a fourth control signal; and a tenth transistor, with a first terminal electrically coupled to the first terminal of the ninth transistor, with a second terminal electrically coupled to the second terminal of the ninth transistor, with a gate terminal configured to receive a first control signal, wherein the second terminal of the first transistor is electrically coupled to a first terminal of the second transistor, wherein a second terminal of the second transistor is electrically coupled to a first terminal of the light emitting element, wherein a gate terminal of the second transistor is configured to receive a fourth control signal, and wherein a second terminal of the light emitting element is electrically coupled to the second system voltage terminal.

10. The driving circuit of claim 1, further comprising:

a tenth transistor, with a first terminal electrically coupled to the first system voltage terminal, with a second terminal electrically coupled to a first terminal of the first transistor, with a gate terminal configured to receive the first control signal, wherein a first terminal of the light emitting element is electrically coupled to a first terminal of the tenth transistor, wherein a second terminal of the light emitting element is electrically coupled to the first terminal of the first terminal, wherein the second terminal of the first transistor is electrically coupled to a first terminal of the second transistor, wherein a second terminal of the second transistor is electrically coupled to the second system voltage terminal, and wherein a gate terminal of the second transistor is configured to receive a fourth control signal.

* * * * *